US006007000A

United States Patent [19]

DeLuca

[11] Patent Number: 6,007,000

[45] Date of Patent: Dec. 28, 1999

[54] INJECTOR NOZZLE WITH IMPROVED ENGINE COMBUSTION EFFICIENCY

[75] Inventor: Frank DeLuca, Enfield, Conn.

[73] Assignee: Alfred J. Buescher, Shaker Heights, Ohio

[21] Appl. No.: 09/097,944

[22] Filed: Jun. 16, 1998

[51] Int. Cl.[6] ..... F02M 47/00; F02M 61/20

[52] U.S. Cl. ..... 239/88; 239/533.3; 239/533.9

[58] Field of Search ..... 239/88–92, 95, 239/96, 533.1–533.12

[56] References Cited

U.S. PATENT DOCUMENTS

| | | | |
|---|---|---|---|
| 3,006,556 | 10/1961 | Shade et al. | 239/88 |
| 4,153,205 | 5/1979 | Parrish, Jr. | 239/533.9 |
| 4,801,095 | 1/1989 | Banzhaf et al. | 239/533.3 |
| 5,033,679 | 7/1991 | Golev et al. | 239/533.3 |
| 5,467,924 | 11/1995 | Buescher et al. | 239/88 |
| 5,725,157 | 3/1998 | DeLuca | 239/533.9 |

*Primary Examiner*—Lesley D. Morris

*Attorney, Agent, or Firm*—Pearne, Gordon, McCoy & Granger LLP

[57] ABSTRACT

A diesel unit injector of the END type is provided with a sac whose center of volume is located below the center of radius of the sac bottom. The bottom-most parts of the annular cavity which is above the seat for the nozzle valve are shaped to provide compensatory structural reinforcement.

7 Claims, 1 Drawing Sheet

INJECTOR NOZZLE WITH IMPROVED ENGINE COMBUSTION EFFICIENCY

FIELD OF THE INVENTION

This invention relates generally to fuel injection nozzles used in diesel engines, and particularly to locomotive engine fuel injectors which are unit injectors of the type known as EMD injectors, originally manufactured by Diesel Equipment Division of General Motors for Electro Motive Division of General Motors.

BACKGROUND OF THE INVENTION

EMD-type unit injectors are characterized by a nozzle valve body which terminates in a nozzle tip and houses a nozzle valve. The seat for the nozzle valve is formed at or near the nozzle tip and communicates with a small spray hole feed chamber or "sac," just below the seat and within the tip. The lower end of the nozzle valve projects into the sac in both open and closed positions of the valve, projecting somewhat further into the sac in closed position. The sac typically has a cylindrical sidewall and a hemispherical bottom wall. The fuel is distributed through the sac under high pressure to spray holes which are several times longer than their diameter. The spray holes lead from the sac through the wall of the injector tip and into the engine chamber where the fuel is atomized.

As pointed out in U.S. Pat. No. 5,467,924 of common assignee, the disclosure of which is incorporated by reference as if fully repeated herein, the diesel engine industry has been under pressure to reduce noxious emissions. However, achievement of acceptably low rates of noxious emissions is by no means the only concern of the industry. In particular, the industry is also under continuing pressure to improve fuel efficiency. Although the diesel engine is the most efficient internal combustion engine used in motive power, there is continuing economic pressure to further reduce fuel costs, and continuing political pressure from conservationists to reduce the rate of consumption of fossil fuels. These pressures are particularly felt in respect of EMD-type locomotive fuel injectors, a type already widely used and whose use can be widely supported by existing networks of rebuilders as well as original equipment manufacturers.

Therefore, achievement of lower emissions is not enough; improvement in fuel efficiency is also of central importance. Cost of manufacture and reliability of operation must also be taken into account.

The present invention accomplishes these combined objectives, relating to fuel efficiency, emissions reduction, cost, and reliability in a particularly effective manner. The present invention maintains emissions in EMD-type injectors at the lowest levels previously accomplished (or lower), while at the same time improving fuel efficiency, all at no increase in manufacturing costs and no reduction in reliability of operation.

The present invention involves configuring the sac so that its center of volume is located below the center of radius of the sac bottom. This is believed to be a departure from all prior art EMD-type injectors (in which the center of the sac volume has been above the center of radius of the sac bottom). While the reasons for the improved performance of the invention are not fully understood, it is believed that this change in configuration from the prior art results in a more laminar (less turbulent) distributive flow of the fuel through the sac to the spray holes when the nozzle valve is opened by lifting it from its conical valve seat to allow the highly pressurized fuel to flow into the sac. It is believed that the less turbulent flow of fuel into the body sac and especially at the entrance of the nozzle orifices in the sac, provides increased penetration of the fuel spray into the combustion chamber thereby improving the distribution of fuel throughout the combustion chamber for a "more complete" burning of the fuel.

Whatever the complete explanation of the improvement in the spray formation, flow conditions are changed so as to improve fuel efficiency as well as reduce noxious emissions below the best known to have been previously achieved with EMD-type injectors.

In the design of diesel injectors of the type to which the invention relates, maintaining the integrity of the durability characteristics of the nozzle is a primary consideration because performance improvement at the expense of reliability is unacceptable. In this connection, any modifications in sac configuration must be accomplished without any compromise in structural strength of the structure at the nozzle tip. The present invention also contemplates modifications of the nozzle body shape to maintain the required structural strength despite the configuring of the sac so that its center of volume is below the center of radius of the sac bottom.

These improvements will be more fully understood from the following detailed description of the invention.

BRIEF DESCRIPTION OF THE DRAWINGS

FIG. 4 has the same fairing as shown in FIG. 2, while FIG. 5 has a somewhat modified fairing.

DETAILED DESCRIPTION OF THE INVENTION

Figure 1:
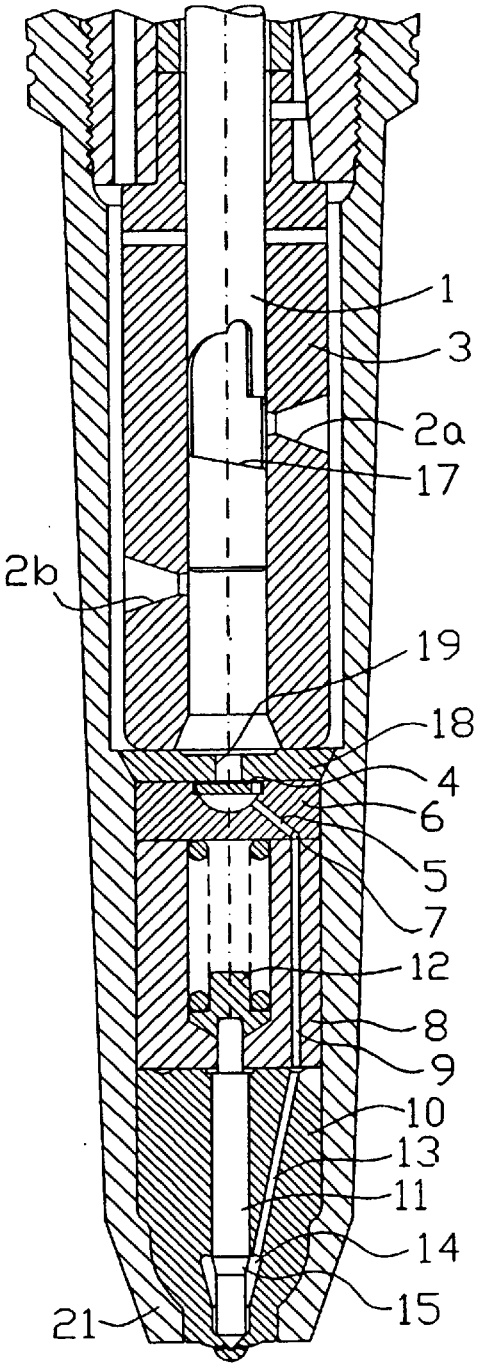
FIG. 1 is a fragmentary cross-sectional view of a EMD-type injector embodying the invention.

The nozzle tip of the invention is intended for use in an diesel locomotive fuel injection nozzle of the EMD type. A nozzle of such type is shown in cross-section in FIG. 1.

The housing nut 21 of the illustrated nozzle is threaded to and is an extension of the main housing (not shown) for the pump injection unit. The nut 21 extends from the main housing, which is at the exterior of the engine, through the engine wall to the combustion chamber, and is clamped in the engine wall in a well known manner. The housing nut houses the stacked main injector components mentioned below and threadedly clamps them in their stacked relationship in a well known manner.

EMD-type nozzles have a valve with differentially sized guide and seat so that there is a fixed relationship between the valve opening and closing pressures. During injector operation when the plunger 1 covers the fill port 2*a* in the bushing 3, a pressure wave is generated which travels past the check valve 4 and through the fuel ducts 5 in the check valve cage 6, through the annulus 7, fuel ducts 9 in the spring cage 8, into the illustrated connecting tip annulus and the fuel ducts 13 of the nozzle body 10, and into the annular cavity 14 where the pressure wave acts on the conical differential area 15 of the nozzle valve 11 to lift the needle of the nozzle valve off its seat, and injection begins.

The valve stays lifted during the time fuel is being delivered by the plunger 1 to the nozzle 10. When the plunger helix edge 17 uncovers the spill port 2*b* in the bushing 3, the pressure above the plunger drops to fuel supply pressure and the check valve 4 in the valve cage 6 seats on the plate 18, sealing the fuel transport duct 19. As these events occur, the pressure in the nozzle fuel chamber or annular cavity 14 then drops rapidly; when it drops to the valve closing pressure, the valve closes and injection ends.

In a well known manner, the angular position of the plunger is changed by a control rack (not shown) to control the amount of fuel delivered with each stroke of the plunger 1 by varying the positions of the stroke at which the fill and spill ports 2*a* and 2*b* are closed and opened.

Figure 2:
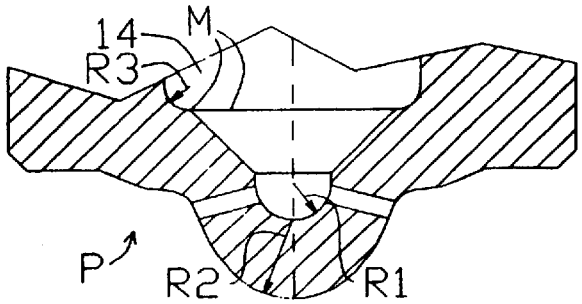
FIG. 2 is a view on an enlarged scale of the lower part of the nozzle body 10 seen in FIG. 1.
Figure 3:
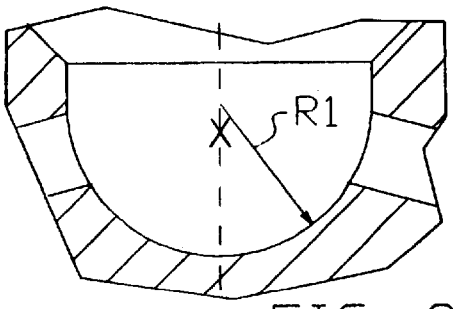
FIG. 3 is a diagram on a still larger scale showing the sac of the nozzle body.

The housing-nut 21 has an open lower end through which the end face of the nozzle body 10 is exposed. FIG. 2 shows the end face of nozzle body 10 on an enlarged scale and in clearer detail. The exterior of the sac dome forms the central part of this end face. The sac dome is faired into the annular portion P of the end face immediately radially outward of the dome itself. According to the present invention and as shown in the drawings, the nozzle sac is configured so that its center of volume X (FIG. 3) is located below the center of the radius R1 of the sac bottom. For a sac having a cylindrical side wall and a hemispherical bottom wall, as shown, this means that the altitude of the cylinder defined by the sac's side wall is less than ⅔ the radius of the hemispherical bottom wall. In the illustrated apparatus, the altitude of the cylinder forming the top part of the sac can be seen to be considerably less than ⅔ the radius R1, as can be judged from the spacing of the center of volume X considerably below the center of the radius R1. In the construction illustrated, the radius R1 is 0.031 inches (0.787 mm) and the altitude of the cylinder forming the upper part of the sac (the part above the center of the radius R1) is 0.008 inches (0.2032 mm), considerably less than ⅔ of the radius R1, which is slightly over 0.02 inches or 0.5 mm. In the construction shown, the center of the dome radius R2 of the nozzle tip is at the bottom of the sac, but the center of the dome radius can be located at other positions along the body axis.

As previously indicted, while the theory behind the improvement provided by the present invention is not fully understood, it is believed the change in sac configuration contemplated by the invention results in a more laminar (less turbulent) distributive flow of the fuel through the sac to the spray holes when the nozzle valve is opened by lifting it from its conical valve seat to allow the highly pressurized fuel to flow into the sac. This belief is reinforced by observations, in the course of research leading up to the invention, that lowering the sac volume center relative to the center of radius unexpectedly increases fuel efficiency out of proportion to the reduction in sac volume incident to such change in configuration. In one comparison, sac volume was reduced by 1.53 cubic millimeters which represented 0.21 percent of the engine full load fuel delivery per injector. Improvement in fuel economy measured 2.53 percent, a full 2.32 percent greater than the 0.21 percent reduction in sac volume. This lack of proportionality indicates that the state of the fuel ahead of the spray holes or orifices is altered by lowering the center of the sac volume relative to the center of radius of the sac volume in the manner disclosed. Whatever the mechanism, the invention changes flow conditions so as to improve fuel efficiency as well as reduce noxious emissions below the best know to have been previously achieved with EMD-type injectors.

Figure 4:
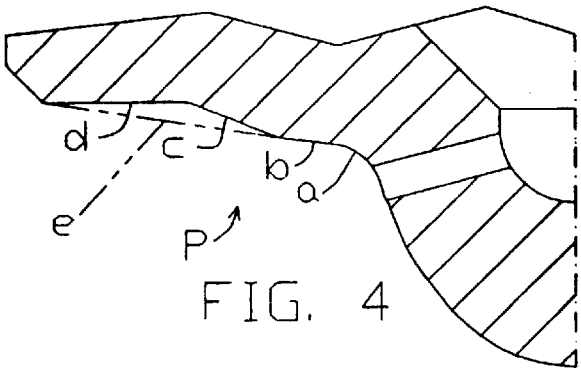
FIGS. 4 and 5 are diagrams on an intermediate scale showing one half of the end face of the nozzle body.

As shown in FIG. 4, the fairing starting at the annular zone P preferably comprises a reverse curve a, a shallow (7 degrees) frustoconical portion b, a steeper (22 degrees) frustoconical portion c, and a flat portion d which extends out to the illustrated chamfer at the outer edge, or to an equivalent blending radius (not shown). Of course the shallower the frustrocone, the greater its included angle, so that shallow frustroconical portion b has an included angle (176 degrees) that is larger, than the included angle (136) of the steeper portion c.

Alternatively, the shallow zone b may simply be continued at the same angle as the frustroconical portion c, shown in phantom in FIG. 4, out to the illustrated chamfer or equivalent blending radius.

Figure 5:
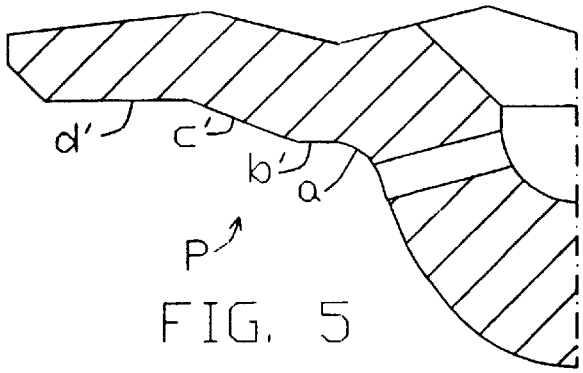

Sill another preferred fairing is shown in FIG. 5 and is generally similar to that shown in solid lines in FIG. 4 except that the shallow frustocone b is replaced by flat portion b', and the steeper frustocone c is replaced by frustocone c' which has the same angle but a slightly greater radial extent than frustocone c.

The configuring of the sac so that the center of the sac radius is above the center of the sac volume tends to foreshorten the sac, and this foreshortening together with the need to fair the sac dome into the radially outer parts of the end face of the nozzle body tends to reduce the wall thickness of the nozzle body 10 immediately above the annular portion P of the end face of the nozzle body 10 compared to what it would be in a sac configured as in the prior art, for example as in the injector structures shown in my U.S. Pat. No. 5,467,924. According to the present invention, compensatory structural reinforcement is provided by changing the shape of the wall of the lower end of the annular cavity 14 in the vicinity where such cavity wall joins the conical seat of the nozzle valve.

Whereas in prior injectors of the EMD type, the bottom-most parts of such cavity wall were generally horizontal and were joined to the longitudinally extending portions of the wall by a fillet of relatively small radius, in the preferred practice of the invention, the bottom-most parts of the cavity wall are shaped differently. Viewed in cross-section, and starting from the junction between the wall of the cavity 14 and the conical seat of the nozzle valve (such junction forming the mouth M of the conical seat as shown in FIG. 2), such bottom-most parts of the cavity wall extend radially outward and also commence an upward rise toward a transition point where they start to rise faster than they extend radially outward. Such rise commences at a point close enough to such junction that such rise extends over at least the majority of, and preferably substantially all of, the radial distance between such junction and such transition point. Most preferably, this is accomplished simply by joining the mouth of the conical seat to the lower vertical wall portions of the annular cavity 14 by a fillet of radius R3 (FIG. 2), such radius being equal to the radial distance between such vertical wall portions and the rim or mouth M. In this specific arrangement, the upward rise commences at mouth M of the valve seat and continues at an ever-increasing slope. In this example, the transition point at which the bottom-most parts of the cavity wall start to rise faster than they extend radially outward is of course at the point which is 45 degrees up the 90 degree fillet, and the rise continues to increase in slope past the 45 degree point and until the wall becomes vertical. However, in other arrangements, the rise may in whole or in part include a slope of constant value, and/or the transition point may be associated with a relatively abrupt transition from a relatively gentle upward slope to full vertical.

The foregoing improvements and combinations of improvements substantially improve the fuel efficiency of EMD-type locomotive engines and at the same time maintaining emissions at the low levels previously accomplished (or lower), all at no increase in manufacturing costs and no reduction in reliability of operation. It should be evident that this disclosure is by way of example, and that various changes may be made by adding, modifying or eliminating details without departing from the fair scope of the teaching contained in this disclosure. For example, as previously indicated, the center of the sac dome radius may for example be raised above the bottom of the sac, so long as the center of volume of the sac is below the center of radius of the sac bottom. The invention is therefore not limited to particular details of this disclosure except to the extent that the following claims are necessarily so limited.

What is claimed is:

1. In a diesel unit injector of the EMD type having a plunger and bushing assembly to meter and deliver fuel, a check valve cage and check valve for preventing reverse flow of the fuel, a spring cage and a spring and spring seat within the cage, an injection nozzle body, a high pressure seal nozzle valve slidable in said nozzle body under the bias of said spring, axially extending fuel ducts in said check valve cage, spring cage and nozzle body, a housing-nut surrounding said plunger and bushing assembly, check valve cage and check valve, spring cage, spring and spring seat, injection nozzle body, high pressure seal nozzle valve, and axially extending fuel ducts, and threadedly claiming said bushing assembly, check valve cage and nozzle body in stacked relationship, said housing-nut having an end face exposed through said open lower end of said housing-nut, said end face comprising an inverted central dome of a given radius forming a nozzle tip, an edge zone, and a fairing zone between said dome and said edge zone, said faring zone being shaped to fair said dome into said edge zone, a fuel sac formed in said tip and having a hemispherical sac bottom of a radius smaller than said dome radius, the centers of said dome radius and said sac bottom radius each lying on the central longitudinal axis of said injector, said nozzle body having a valve seat against which said nozzle valve seats under the bias of said spring and through which fuel flows into said sac under control by said nozzle valve, said sac communicating with nozzle spray holes through which fuel flows into the engine combustion chamber, the points of communication between said sac and said nozzle spray holes being spaced below nozzle said valve seat, the improvement wherein the center of volume of said sac is located below the center of radius of said sac bottom.

2. An injector as in claim 1, said nozzle body having an annular cavity through which fuel flows to said nozzle valve seat, said cavity surrounding the stem of said valve, the bottom-most parts of the wall of said annular cavity and said nozzle valve seat being joined to form the mouth of said nozzle valve seat, said bottom-most parts of the wall of said annular cavity, viewed in cross section, and starting from said mouth, extending radially outward and also commencing an upward rise toward a transition point where they start to rise faster than they extend radially outward, such rise commencing at a point close enough to said mouth that such rise extends over at least the majority of the radial distance between said mouth and said transition point.

3. An injector as in claim 2, said rise extending over substantially all the radial distance between said mouth and said transition point.

4. An injector as in claim 3, said rise comprising a fillet having a radius equal to the radial distance between said mouth and vertically extending parts of said wall of said annular cavity.

5. An injector as in claim 1 wherein said nozzle body has a bottom surface with a fairing zone comprising a reverse curve surface of substantially smaller radius than said dome radius, a shallowly angled frustoconical surface surrounding and blending into said reverse curve surface, a more steeply angled frustoconical surface surrounding said shallowly angled one, and a flat face portion surrounding said more steeply angled frustoconical surface and extending to a chamfer or blending radius at the outside diameter of said nozzle body.

6. An injector as in claim 1 wherein said nozzle body has a bottom surface with a fairing zone comprising a reverse curve surface of substantially smaller radius than said dome radius, a shallowly angled frustoconical surface surrounding and blending into said reverse curve surface and extending to a chamfer or blending radius at the outside diameter of said nozzle body.

7. An injector as in claim 1 wherein said nozzle body has a bottom surface with a fairing zone comprising a reverse curve surface of substantially smaller radius than said dome radius, a narrow flat annular surface surrounding and blending into said reverse curve surface, an angled frustoconical surface surrounding said narrow flat annular surface, and a flat face portion surrounding said frustoconical surface and extending to a chamfer or blending radius at the outside diameter of said nozzle body.

* * * * *